US007615127B2

(12) United States Patent
Elder et al.

(10) Patent No.: US 7,615,127 B2
(45) Date of Patent: Nov. 10, 2009

(54) PROCESS OF PRODUCING OVERHEAD TRANSMISSION CONDUCTOR

(75) Inventors: Danny S. Elder, Montoursville, PA (US); Janusz Sekunda, Williamsport, PA (US)

(73) Assignee: Alcan International, Ltd., Montreal, Quebec (CA)

( * ) Notice: Subject to any disclaimer, the term of this patent is extended or adjusted under 35 U.S.C. 154(b) by 444 days.

(21) Appl. No.: 10/844,648

(22) Filed: May 12, 2004

(65) Prior Publication Data

US 2005/0005433 A1 Jan. 13, 2005

Related U.S. Application Data

(60) Provisional application No. 60/470,329, filed on May 13, 2003.

(51) Int. Cl.

| | |
|---|---|
| ***C22F 1/04*** | (2006.01) |
| ***H01R 43/00*** | (2006.01) |
| ***H01B 5/08*** | (2006.01) |
| ***H01B 5/10*** | (2006.01) |

(52) U.S. Cl. ..... 148/688; 29/825; 174/128.1; 174/130

(58) Field of Classification Search ..... 148/688; 29/825; 174/128.1, 130

See application file for complete search history.

(56) References Cited

U.S. PATENT DOCUMENTS

| | | | | |
|---|---|---|---|---|
| 1,931,912 A | * | 10/1933 | Whitzel | 72/201 |
| 3,615,371 A | | 10/1971 | Nakajima et al. | 75/147 |
| 3,711,339 A | | 1/1973 | Besel et al. | 148/32.5 |
| 3,813,481 A | | 5/1974 | Adams | 174/130 |
| 3,813,772 A | | 6/1974 | Adams | 29/624 |
| 4,082,573 A | | 4/1978 | Schoerner et al. | 148/2 |
| 4,140,549 A | | 2/1979 | Chia et al. | 148/2 |
| 4,161,416 A | | 7/1979 | Walton, III | 148/12.7 |
| 4,234,359 A | | 11/1980 | Chia et al. | 148/2 |

(Continued)

FOREIGN PATENT DOCUMENTS

| | | |
|---|---|---|
| EP | B1 0 254 698 | 5/1990 |

(Continued)

OTHER PUBLICATIONS

"Standard Specification for Aluminum 1350 Drawing Stock for Electrical Purposes", American Society for Testing and Materials, Designation: B 233-97, pp. 1 to 4.

(Continued)

*Primary Examiner*—Roy King
*Assistant Examiner*—Jessee R. Roe
(74) *Attorney, Agent, or Firm*—Cooper & Dunham LLP

(57) ABSTRACT

A process of producing an overhead transmission conductor. The process comprises: (a) continuously hot rolling a bar of AA 1350 aluminum or a similar aluminum alloy to form a rod; (b) hot-coiling the rod at a temperature preferably in a range of about 300 to 400° C. to provide an aluminum electrical conductor rod having an electrical conductivity in a range of 61.8 to 64.0% IACS and a tensile strength in a range of 8,500 to 14,000 psi; (c) without subjecting the rod to an annealing treatment, drawing the rod into wire: and (d) stranding the wire into cable to form the overhead transmission conductor. The invention also relates to an ACSS conductor produced by the process.

7 Claims, 1 Drawing Sheet

U.S. PATENT DOCUMENTS

| | | | | |
|---|---|---|---|---|
| 4,397,696 | A | 8/1983 | Vasudevan | 148/11.5 |
| 4,402,763 | A | 9/1983 | Sato et al. | 148/2 |
| 4,687,884 | A | 8/1987 | DeHart | 174/130 |
| 5,243,137 | A | 9/1993 | Gentry | 174/128.1 |
| 5,374,783 | A | 12/1994 | Gentry | 174/128.1 |
| 5,554,826 | A | 9/1996 | Gentry | 174/128.1 |
| 6,559,385 | B1 * | 5/2003 | Johnson et al. | 174/126.1 |

FOREIGN PATENT DOCUMENTS

| | | |
|---|---|---|
| EP | A1 0 576 275 | 12/1993 |
| EP | B1 0 691 719 | 6/1997 |
| EP | B1 0 787 811 | 5/2000 |

OTHER PUBLICATIONS

"Standard Specification for Shaped Wire Compact Concentric-Lay-Stranded Aluminum Conductors, Coated-Steel Supported (ACSS/TW)", American Society for Testing and Materials, Designation: B 857-02, pp. 1 to 7.

"Standard Specification for Concentric-Lay-Stranded Aluminum Conductors, Coated Steel Supported (ACSS)", American Society for Testing and Materials, Designation: B 856-01a, pp. 1 to 8.

* cited by examiner

PROCESS OF PRODUCING OVERHEAD TRANSMISSION CONDUCTOR

CROSS-REFERENCE TO RELATED APPLICATION

This application claims the priority right of provisional application Ser. No. 60/470,329 filed May 13, 2003 by applicants herein.

FIELD OF THE INVENTION

The present invention relates to the manufacture of overhead transmission conductors, preferably so-called "aluminum conductor steel supported" cables (ACSS).

BACKGROUND OF THE INVENTION

Aluminum is a metal which offers a good compromise between electrical conductivity, mechanical strength, weight and cost. As such, the use of aluminum wire or cable as an electrical conductor has increased significantly in recent times. There are many possible applications where aluminum wire or cable could be used only if certain physical and mechanical properties are achieved. One of the most important applications is an overhead transmission conductor.

Steel reinforced aluminum cable (ACSR) or aluminum conductor steel supported (ACSS) for use as overhead transmission conductors have been developed for decades. For example, U.S. Pat. No. 3,813,481 discloses a steel supported aluminum overhead conductor (SSAC). According to this patent, conventional 61% IACS (International Annealed Copper Standard) aluminum rod is drawn by conventional means to wire form in a drawing step, then the drawn wire is fully annealed. This drawn, fully annealed wire is soft and easily subject to damage and, thus, must be handled carefully in a subsequent stranding step. That is, since the wire is extremely soft ("dead soft"), the surface is easily scratched or damaged; such scratches are an important cause of arcing and corona in the finished overhead transmission conductor cable. Therefore, special precautionary steps must be performed during the stranding process. These precautionary steps include applying a liquid lubricant to the surface of the fully annealed aluminum wires, reducing the back-tension on the aluminum wires passing through the stranding machine, reducing the operating speed of the stranding machine, modifying the wire guides to minimize scuffing (which can cause scratches), enlarging the closure dies which press the annealed stranded wires against the steel core, and reducing the pressure of the closing dies.

As an attempt to solve the problems associated with the above patent, U.S. Pat. No. 5,554,826 discloses a method of producing an improved overhead transmission conductor. First of all, 99.8% (or greater) purity aluminum is selected to maximize the conductivity in the finished product. The aluminum is preferably continuously cast and rolled normally to form a rolled rod product. The aluminum rod product is then fully annealed by conventional methods at an elevated temperature for a time period sufficient to assure recrystallization resulting in a reduction of the tensile strength to approximately 9.0 kilopounds (thousands of pounds) per square inch (ksi). The annealed rod is drawn to the desired size, which introduces strain hardening of a strength in the range of 20.0 ksi. Then, a stranding operation forms the aluminum conductor wires into at least one layer having a spiral twist, or lay, over the stranded steel cable which forms the core. As a result of hardening occurring before and during the drawing and stranding processes, the aluminum components of the cable are not at the desired "0" temper or "dead soft" condition following stranding (as required by the ASTM B233-1350-O specification). The overhead transmission conductor is therefore subjected to a stress-relieving/annealing heat treatment to produce a dead soft condition in the aluminum components.

The conventional processes as discussed above embrace many problems and disadvantages in terms of the efficiency and cost of the processes. For example, the use of high purity aluminum is very expensive, as are full annealing treatments carried out before or possibly after the standing process.

There is, therefore, a need to overcome some or all such prior art problems and provide a new technology for producing an aluminum overhead transmission conductor in a cost effective manner.

SUMMARY OF THE INVENTION

According to one aspect of the invention, there is provided a process of producing an overhead transmission conductor, the process comprising the steps of: (a) continuously hot-rolling a bar of AA1350 aluminum (Aluminum 1350) into the shape of rod; (b) hot-coiling the hot-rolled rod at a temperature in a range between about 300 and 400° C. to produce a coiled aluminum electrical conductor rod having an electrical conductivity in a range of 61.8 to 64.0% IACS and a tensile strength in a range of 8,500 to 14,000 psi; (c) drawing the rod into wire without subjecting the rod to annealing: and (d) stranding the wire into cable.

According to another aspect of the invention, there is provided a process of producing an overhead transmission conductor, which comprises: (a) continuously hot-rolling a bar of AA 1350 aluminum or a similar aluminum alloy to form a rod; (b) hot-coiling the rod to provide an aluminum electrical conductor rod; (c) without subjecting said rod to an annealing treatment, drawing said rod into wire: and (d) stranding said wire into cable to form said overhead transmission conductor.

By the term "hot-coiling" we mean a process by which conductor rod is wound directly and without interruption or intervention onto a winding form (e.g. a mandrel) from the hot-rolling apparatus. The hot-rolling and coiling are carried out at temperatures such that the rod, when wound on the winding form, preferably has a temperature in the range of about 300 to 400° C. (±3%). There is no specific cooling step or significant time for cooling between the hot-rolling and winding (coiling) steps, and the coiled rod is not subjected to a heat treatment (annealing) prior to being drawn to wire and used to produce conductor cable. The coiled rod may be allowed to cool to ambient temperature before being transferred to drawing and stranding apparatus.

As noted above, there is no annealing step carried out between the production of the rod and the drawing to form wire, since the rod is hot-coiled. This can be expressed as forming and drawing while avoiding heat-treatment annealing, or as drawing unannealed, heat-coiled rod. The lack or avoidance of any annealing step between the hot-coiling step and the drawing step means that the process is relatively easy to carry out and is cost-effective. The use of ASTM 1350 alloy also leads to simplicity and cost effectiveness.

A further understanding of other aspects, features and advantages of the present invention will be realized by reference to the following description, appended claims and accompanying drawings.

BRIEF DESCRIPTION OF THE DRAWINGS

The embodiment(s) of the present invention are described with reference to the accompanying drawings, in which.

DETAILED DESCRIPTION OF THE PREFERRED EMBODIMENT(S)

Figure 1:
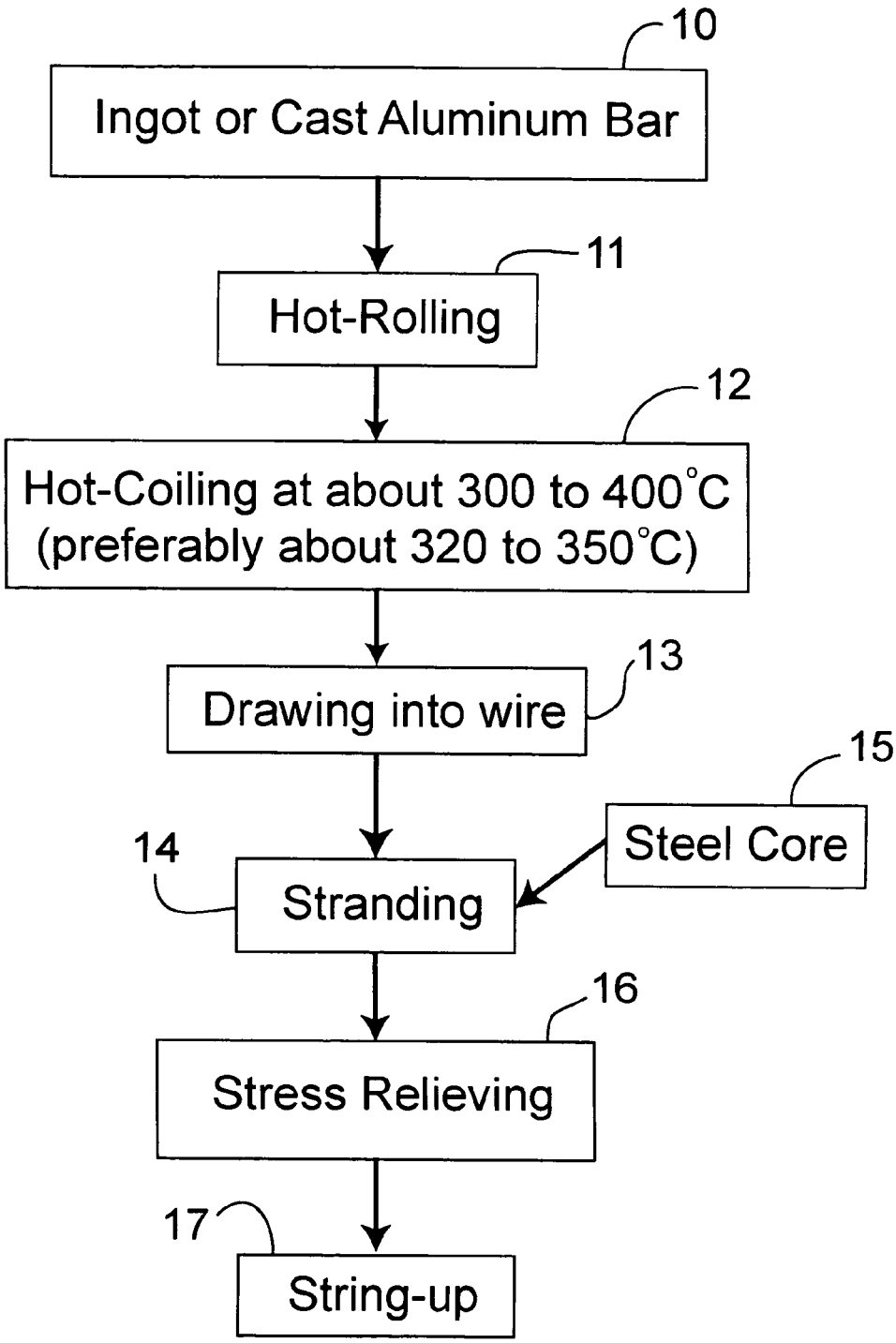
FIG. 1 is a diagram illustrating the processing step sequence in accordance with the present invention.

The present invention, at least in preferred forms, makes use of electrical grade (EC) aluminum alloy, particularly AA 1350 alloy, which is relatively inexpensive compared with high purity aluminum. AA 1350 aluminum alloy contains a maximum of 0.05% by weigh copper and has a minimum electrical conductivity relative to pure copper (IACS) of 63% IACS in the fully annealed state. The ASTM 1350 standard requires a conductivity of 61.8% to 64% IACS and an ultimate tensile strength (UTS) in the range of 8,500 to 14,000 pounds per square inch (psi) for the alloy to be considered "1350-0" or fully annealed (ASTM B233) Aluminum 1350 Drawing Stock for Electrical Purposes.

A full listing of the components of 1350 alloy are as shown in Table 1 below (as specified by ASTM B 233-97, Table 2, Chemical Requirements, American Society for Testing and Materials, 100 Barr Harbor Dr., West Conshohocken, Pa. 19428, USA):

TABLE 1

| Element | % by Weight |
|---|---|
| Silicon (Maximum) | 0.10 |
| Iron (Maximum) | 0.40 |
| Copper (Maximum) | 0.05 |
| Manganese (Maximum) | 0.01 |
| Chromium (Maximum) | 0.01 |
| Zinc (Maximum) | 0.05 |
| Boron (Maximum) | 0.05 |
| Gallium (Maximum) | 0.03 |
| Vanadium + Titanium (Total Maximum) | 0.02 |
| Other elements (each, Maximum) | 0.03 |
| Other elements (total, Maximum) | 0.10 |
| Aluminum (Minimum) | 99.50 |

By using ASTM 1350 aluminum alloy in the present invention, the process is made much less expensive than using high purity aluminum. This alloy is available from many sources, so no special inventory of metal is required.

Using such aluminum alloy, the present invention avoids the need for a full batch anneal to be carried on conductor rod used for drawing into wire. The conductor rod is formed by continuously hot-rolling a cast alloy bar at a temperature such that, at the end of the hot rolling procedure, the rod is coiled on a suitable winding form while at a temperature of at least about 300° C. (±3%), preferably in the range of about 300 to 400° C., and more preferably in the range of about 320 to 350° C. If the rod is coiled at a temperature significantly below 300° C., the consequent increased work hardening will produce a high tensile strength product, i.e. above 14,000 psi. The upper limit of the coiling temperature is not specifically limited, provided the metal remains solid, but practical problems (with equipment and personnel) may arise if the coiling is carried out at a temperature much above about 400° C. Provided that the rod has a temperature of at least about 300° C. when coiled, the ambient temperature and cooling rate in the coiled condition are not significant. What is important is that, because of the high temperature used for hot rolling, particularly in the final step that includes coiling, the alloy has not undergone significant work hardening during rolling and therefore there is no requirement for an expensive batch annealing step at this stage of the process. The hot coiling may also produce some self-annealing of the rod. The hot coiled rod is packaged at high temperature such that the metal is not fully recrystallized. By avoiding work hardening, the metal reaches the fully annealed state without further heat treatment. Moreover, the hot coiled rod has less mechanical damage and has improved lubrication, facilitating further processing.

The hot rolling of the ingot or billet may be carried out by the conventional Properzi aluminum rod rolling process, although the process is completed at a higher temperature than normal, as indicated above.

The hot coiled rod has typical mechanical properties (tensile strength) that are slightly higher and typical electrical conductivity that is slightly lower than metal that has been fully annealed after rolling. However, these properties still comply with the ASTM B233 1350-0 specification. Typically, the rod has a conductivity of 62.5 to 63.5% IAOS.

The resulting hot coiled rod is then drawn into wire by conventional drawing techniques. The wire is then stranded, usually around a supporting steel cable, to produce an overhead conductor in cable form. At this stage, a stress-relieving or annealing treatment may be carried out. However, the cable resulting from the process of the invention generally requires a less severe heat treatment and a shorter annealing cycle than cable produced by conventional techniques. Cable produced from hot coiled rod according to the present invention generally benefits from a heat treatment in the range of 250 to 325° C. (typically 300° C.) for a period of time of 2 to 20 hours (typically about 8 hours). However, relatively large drawn wire sizes (e.g. in the range of 0.18 to 0.350 inch diameter) generally do not require an annealing treatment at all.

The resulting ACSS cable must comply with standards (e.g. ASTM B856 and 857). In addition, cable produced by this method achieves a minimum average IACS of 63%. This minimizes losses of electricity during transmission.

The process of the present invention, at least in one preferred form, is illustrated by FIG. 1 of the accompanying drawings. As shown, ingot or cast bar of ASTM 1350 aluminum alloy 10 is subjected to a series of hot-rolling steps 11 until a conductor rod is formed having a diameter in the range of 9.52 to 25.40 mm (as required by ASTM B233). After the final hot-rolling step, the rod is hot-coiled 12 while at a temperature in the range of about 300 to 400° C., preferably 320 to 350° C. The hot-coiling is carried out using a mandrel as a winding form, and then the mandrel is withdrawn, leaving a self-supporting coil. The rod from the coil is then drawn into wire 13 using conventional wire drawing dies and equipment. The wire is then stranded 14 around a steel core 15 to form aluminum conductor steel supported cable (ACSS) which is preferably subjected to a stress-relieving heat treatment 16 at a temperature of 300° C. for a time of 2 hours. The cable is then ready to be used, i.e. for string-up 17.

EXAMPLES

Example 1

Coiling

The aluminum rod employed in this test was LaPoint Continuous Cast AA1350 of 9.5 mm R 1.0—Coil Numbers 12438, 44, 53, 54, 49

The rod produced was "Hot Coiled" at a temperature above 300° C. and had an actual Tensile Strength of 86 to 102 MPa.

Drawing

The rod was wire drawn and rolled at 800 meters/mm 13 die Vaughn Drawbench and was spooled on 25 inch bobbins.

After drawing, wire 2.7 to 3.3% Elong., the tensile strength was 120 to 141 MPa.

Stranding Set-Up

Normal for producing electrical cable

Approx. 10,000 feet produced

Batch Anneal (Higher than Originally Planned Due to Variable Tensile Rod)

320° C. first Hour; 300° C. for approx. 24 hrs, until T/C @285° C. for 2 hrs.

The finished conductor was in compliance with specifications.

Example 2

The rod employed was Hot Coiled 1350 Aluminum 9.5 mm Rod having an electrical conductivity of 62.5 to 62.8% IACS Actual.

The rod was produced under the following conditions:

| Bar Temperature | Actual Coiling Temp | Emulsion Temp |
|---|---|---|
| 500° C. | 297-300° C. | 52-54° C. |
| 485-500° C. | 291-295° C. | 49° C. |

The actual Tensile Strength was 70 to 78 MPa.

Rolling Practice No. L1350-1

Entry Bar Temperature 500° C.+/−15° C.

Emulsion Temperature 53 +/−2° C.

Diameter: 9.6 +/−0.2 mm

| Roll | Valve Position by Roll Stand Number | | | | | | | |
|---|---|---|---|---|---|---|---|---|
| Stand # | 1 | 2 | 3 | 4 | 5 | 6 | 7-14 | 15 |
| Rolls | 3 | 3 | 4 | 5 | 6 | 7 | 8 | 8 |
| Guides | 3 | 3 | 4 | 5 | 7 | 8 | 8 | 0 |

| Casting Practice # C1350-3 | |
|---|---|
| Casting Speed RPM | 2.80 +/− .05 |
| Exit Bar Temperature | 600 +/− 15° C. |
| Furnace Metal Temperature | 715 +/− 15° C. |
| Metal Temperature before Casting Wheel | 685 +/− 20° C. |

Cooling Water on Casting Wheel

| Section | Flow liters/min. | Pressure Model A Nominal Kpa | Pressure Model B Nominal Kpa |
|---|---|---|---|
| 2 | 55 +/− 5 | 35 +/− 5 | 23 +/− 5 |
| 3 | 105 +/− 5 | 145 +/− 10 | 155 +/− 10 |
| 5 | — | — | — |
| 6 | 240 +/− 10 | 40 +/− 5 | |
| 7 | 120 +/− 5 | 130 +/− 5 | |
| 8 | 135 +/− 5 | 90 +/− 10 | |

The finished conductor was in compliance with specifications.

While the present invention has been described with reference to several preferred embodiments, the description is illustrative of the invention and is not to be construed as limiting the invention. Various modifications and variations may occur to those skilled in the art without departing from the scope of the invention as defined by the appended claims.

What we claim is:

1. A process of producing an overhead transmission conductor, which consists of:

(a) hot-rolling a continuous cast alloy bar of AA 1350 aluminum alloy having a maximum copper content of 0.05 wt. % to form a rod;

(b) then directly hot-coiling the rod at a temperature in a range of about 300 to 400° C. and allowing the coiled rod to cool to ambient temperature to provide an aluminum electrical conductor rod having an electrical conductivity in a range of 61.8 to 64.0% IACS and a tensile strength in a range of 8,500 to 14,000 psi;

(c) without subjecting said rod to an annealing treatment, drawing said rod into wire; and (d) stranding said wire into cable to form said overhead transmission conductor.

2. The process of claim 1, wherein said wire is stranded around a steel core to form aluminum conductor steel supported (ACSS) conductor.

3. The process of claim 1, wherein in the step (b) the hot-rolled rod is hot-coiled at a temperature in a range of about 320 to 350° C.

4. The process of claim 1, wherein the aluminum electrical conductor rod has an electrical conductivity in a range of about 62.5 to 63.5% IACS.

5. The process of claim 1, wherein the hot rolling is carried out to produce said rod having a diameter range of 9.52 to 25.40 mm.

6. A process of producing an overhead transmission conductor, which consists of:

(a) hot-rolling a continuous cast alloy bar of AA 1350 aluminum alloy having a maximum copper content of 0.05 wt. % to form a rod;

(b) then directly hot-coiling the rod at a temperature in a range of about 300 to 400° C. and allowing the coiled rod to cool to ambient temperature to provide an aluminum electrical conductor rod having an electrical conductivity in a range of 61.8 to 64.0% IACS and a tensile strength in a range of 8,500 to 14,000 psi;

(c) without subjecting said rod to an annealing treatment, drawing said rod into wire;

(d) stranding said wire into cable to form said overhead transmission conductor; and (e) heat-treating the cable to relieve a stress built up during the stranding step.

7. A process of producing an overhead transmission conductor, which consists of:

(a) hot-rolling a continuous cast alloy bar of AA 1350 aluminum alloy having a maximum copper content of 0.05 wt. % to form a rod;

(b) then directly hot-coiling the rod at a temperature in a range of about 300 to 400° C. and allowing the coiled rod to cool to ambient temperature to provide an aluminum electrical conductor rod having an electrical conductivity in a range of 61.8 to 64.0% IACS and a tensile strength in a range of 8,500 to 14,000 psi;

(c) without subjecting said rod to an annealing treatment, drawing said rod into wire;

(d) stranding said wire into cable to form said overhead transmission conductor; and (e) subjecting the cable to a heat treatment in the range of about 250 to 325° C. for a period of time of 2 to 20 hours.

* * * * *